US005975309A

United States Patent [19]

Mitsuda et al.

[11] Patent Number: 5,975,309

[45] Date of Patent: Nov. 2, 1999

[54] FLUIDIZED-BED CLASSIFIER

[75] Inventors: Yoshihiro Mitsuda, Kakogawa; Seisuke Sawamura, Akashi; Ryuichi Okamura, Kobe; Hiroshi Ueda, Kobe; Fuminori Ando, Kobe; Kanzaburo Sutoh, Tsukumi; Mitsuaki Murata, Kumagaya; Tsutomu Hirobe, Kashiwa, all of Japan

[73] Assignees: Kawasaki Jukogyo Kabushiki Kaisha, Kobe; Taiheiyo Cement Corporation, Tokyo, both of Japan

[21] Appl. No.: 08/838,141

[22] Filed: Apr. 15, 1997

[30] Foreign Application Priority Data

Apr. 18, 1996 [JP] Japan ..... 8-96775

[51] Int. Cl.[6] ..... B07B 4/00

[52] U.S. Cl. ..... 209/474; 209/20; 209/138; 209/494; 209/502

[58] Field of Search ..... 209/20, 138, 139.1, 209/154, 474, 483, 486, 502, 494, 490

[56] References Cited

U.S. PATENT DOCUMENTS

| | | | |
|---|---|---|---|
| 2,069,325 | 2/1937 | Morgan | 209/474 |
| 3,774,759 | 11/1973 | Weintraub et al. | 209/474 |
| 4,115,256 | 9/1978 | de Zeeuw | 209/474 X |
| 4,946,044 | 8/1990 | Havrilla | 209/474 |
| 5,299,694 | 4/1994 | Rambaud | 209/139.1 X |
| 5,388,704 | 2/1995 | Morris | 209/474 X |

FOREIGN PATENT DOCUMENTS

| | | | |
|---|---|---|---|
| 0 648 538 A2 | 4/1995 | European Pat. Off. . | |
| 2258904 | 1/1974 | France | 209/474 |
| 7-108187 | 4/1995 | Japan . | |
| 486814 | 11/1973 | U.S.S.R. | 209/474 |
| 778117 | 7/1957 | United Kingdom . | |

OTHER PUBLICATIONS

*Patent Abstracts of Japan* , vol. 96, No. 3, Mar. 29, 1996, abstract of JP 07 299419 A (published Nov. 14, 1995).

*Primary Examiner*—Tuan N. Nguyen
*Attorney, Agent, or Firm*—Oliff & Berridge, PLC

[57] ABSTRACT

A fluidized-bed classifier has a vessel defining a space divided into an upper fluidized-bed chamber and a lower gas chamber by a perforated dispersion plate having the shape of a funnel. Rising currents of a gas, such as air, are blown through the dispersion plate into the upper fluidized-bed chamber to produce a fluidized bed of a particulate material over the dispersion plate. The lower gas chamber is divided into a first gas chamber and a second gas chamber by a partition plate. The gas is supplied into the first air chamber so that rising gas currents of a velocity necessary for fluidizing coarse particles contained in the particulate material fed into the vessel are blown from the first air chamber through the dispersion plate into the fluidized-bed chamber. The gas is supplied into the second air chamber so that rising gas currents of a velocity lower than the velocity of the rising gas currents blown from the first air chamber into the fluidized-bed chamber are blown into the fluidized-bed chamber so that coarse particles contained in the particulate material are not fluidized and does not flow together with fine particles into a fine particle discharge chute.

6 Claims, 5 Drawing Sheets

FLUIDIZED-BED CLASSIFIER

BACKGROUND OF THE INVENTION

1. Field of the Invention

The present invention relates to a fluidized-bed classifier for classifying a particulate material pre-ground by a roller mill for grinding cement clinker or the like by particle size.

2. Description of the Related Art

FIG. 5 shows the constitution of a cement clinker pre-grinding system disclosed in JP-A No. 7-108187. A fluidized-bed classifier 1 separates coarse particles from the material pre-ground by a roller mill through the agency of a fluidized bed, and returns the separated coarse particles to the roller mill 2 for regrinding. The fine particles separated from the particulate material by the fluidized-bed classifier 1 is fed to a tube mill 4 for further pulverization. The ground material pulverized by the tube mill 4 is conveyed upward by a bucket elevator 5 into a separator 6. The separator 6 separates fine particles from the ground material and delivers the fine particles as a product. Since the material fed to the tube mill 4 is obtained by separating coarse particles from the pre-ground material produced by the roller mill 2, the tube mill 4 may be provided with balls of a relatively small diameter and thereby the energy demand of the cement clinker pre-grinding system can be reduced. The roller mill 2 is replenished with cement clinker fed from the material hopper 7, and the cement clinker fed from the material hopper 7 is ground together with the coarse particles returned to the roller mill 2 from the fluidized-bed classifier 1.

FIG. 6 is a perspective view of the fluidized-bed classifier 1 included in the cement clinker pre-grinding system of FIG. 5. The internal space of a vessel 10 is partitioned into an upper fluidized-bed chamber 12 and a lower air chamber 13 by a perforated dispersion plate 11. Air is supplied through an air inlet 14 into the air chamber 13, and the air is discharged from the fluidized-bed chamber 12 through an air discharge duct 15. The vessel 10 is provided with a material feed chute 16 opening into the fluidized-bed chamber 12. A pre-ground material, such as cement clinker, is supplied through the material feed chute 16 into the fluidized-bed chamber 12, and then the pre-ground material is fluidized in the fluidized-bed chamber 12 by currents of air supplied into the air chamber 13 and blown through the perforations of the dispersion plate 11. The dispersion plate 11 is inclined at an inclination a so as to slope down from a side wall of the vessel 10 on the side of the material feed chute 16 toward a discharge side wall of the same. An upper chute 17 and a lower chute 18 are joined to an upper portion and a lower portion, respectively, of the discharge side wall of the vessel 10. The pre-ground material fed through the material feed chute inlet 16 is fluidized by current of air blown through the perforations of the dispersion plate 11 and flows along the inclined dispersion plate 11 toward the discharge side wall. Fine particles of the material are fluidized and flow upward in the fluidized bed into the upper chute 17, while coarse particles of the material are not fluidized at all, or even though they are fluidized they do not come up to the surface and slide along the inclined dispersion plate 11 into the lower chute 18. Accordingly, it is expected that fine particles are discharged through the upper chute 17 and coarse particles are discharged through the lower chute 18.

This known fluidized-bed classifier 1 shown in FIG. 6 is unable to separate fine particles and coarse particles satisfactorily from each other, because both the upper chute 17 and the lower chute 18 through which fine particles and coarse particles are discharged, respectively, from the vessel 10 are joined to the upper and the lower portion, respectively, of the discharge side wall of the vessel 10. Consequently, fine particles containing some coarse particles are discharged through the upper chute 17 into the tube mill 4 (FIG. 5), and hence the tube mill 4 needs balls of a diameter large enough to crush large particles mixed in small particles. The material has a very wide range of particle size distribution of ten-odd millimeters to several micrometers. Therefore, if such a material is to be fluidized to separate fine particles of particle sizes below several millimeters from the material, coarse particles of particle sizes greater than an upper limit particle size need to be fluidized and hence coarse particles having particle sizes greater than the upper limit particle size are included in fine particles discharged through the upper chute 17.

Since the dispersion plate 11 is a single, inclined, perforated plate, the difference in height between one end of the dispersion plate 11 on the side of material feed chute 16 and the other end of the same on the side of the upper chute 17 and the lower chute 18 is large if the fluidized-bed classifier 1 has a large size. Since the height of the upper stratification of the fluidized bed formed over the dispersion plate 11 is fixed, the difference in thickness between a portion of the fluidized bed on the side of the material feed chute 16 and a portion on the side of the upper chute 17 and the lower chute 18 is very large. Accordingly, it has been difficult to construct the fluidized-bed classifier 1 in a large size.

SUMMARY OF THE INVENTION

Accordingly, it is an object of the present invention to provide a fluidized-bed classifier capable of satisfactorily classifying coarse particles and fine particles and not subject to restrictions on size.

According to one aspect of the present invention, a fluidized-bed classifier for producing a fluidized bed of a particulate material and classifying the particulate material into coarse particles and fine particles by particle size comprises a vessel defining a space; a dispersion plate disposed in the vessel to divide the space defined by the vessel into an upper chamber and a lower chamber to produce a fluidized bed of the particulate material in the upper chamber by rising gas currents blown upward therethrough, and having a sloping upper surface declining from the periphery thereof contiguous with the side walls of the vessel to a lowermost portion thereof; a coarse particle discharge chute having an inlet open end joined to a portion of the dispersion plate corresponding to the lowermost portion of the surface of the same; a partition plate disposed in the lower chamber of the vessel at a position corresponding to the coarse particle discharge chute to divide the lower chamber into a first and a second gas chamber; a material feed chute through which the particulate material is fed into the vessel, joined to an upper wall of the vessel at a position above a portion of the dispersion plate corresponding to the first gas chamber; a fine particle discharge chute having an inlet open end joined to an upper portion of an end wall of the vessel on the side of the second gas chamber; and gas supply means for supplying a gas into the first and the second gas chamber at adjusted flow rates, respectively.

In this fluidized-bed classifier according to the present invention, the level of the central portion of the funneled surface of the dispersion plate is lower than those of other portions of the same, and the coarse particle discharge chute is joined to the portion of the dispersion plate corresponding to the central portion of the funneled surface. The lower chamber under the dispersion plate may be divided by the partition plate disposed in the lower chamber of the vessel at a position corresponding to the coarse particle discharge chute into the first and the second gas chamber. The material feed chute is joined to a portion of the upper wall of the vessel above the first gas chamber. The particulate material supplied through the material feed chute into the vessel is fluidized by the rising gas currents blown through the dispersion plate. Coarse particles move along the sloping surface of the dispersion plate into the coarse particle discharge chute, and fine particles move in the fluidized bed in a portion of the upper chamber above the second gas chamber into the fine particle discharge chute. The gas supply means supplies the gas into the first gas chamber so that even large particles can be fluidized and supplies the gas into the second gas chamber so that coarse particles cannot be fluidized and coarse particles are not mixed in fine particles discharged through the fine particle discharge chute. Thus, the particles of the particulate material can efficiently be classified.

According to the present invention, the end wall of the vessel may have an inwardly declined portion declined toward the interior of the upper chamber of the vessel and merging into the lower wall of the fine particle discharge chute. The inwardly declined portion of the end wall returns coarse particles flowing near to the fine particle discharge chute into the upper chamber of the vessel to prevent the coarse particles from flowing into the fine particle discharge chute together with fine particles.

According to the present invention, the vessel may be provided with a fluidized bed dividing plate disposed in the upper chamber of the vessel so that the upper edge thereof is on a level above the level of the lower side of the inlet open end of the fine particle discharge chute opening into the vessel, and the lower edge thereof is spaced a predetermined distance apart from the inlet open end of the coarse particle discharge chute. Fine particles flow over the upper edge of the partition plate disposed in the fluidized bed, while coarse particles flow below the lower edge of the partition plate, so that fine particles and coarse particles can efficiently be separated from each other.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
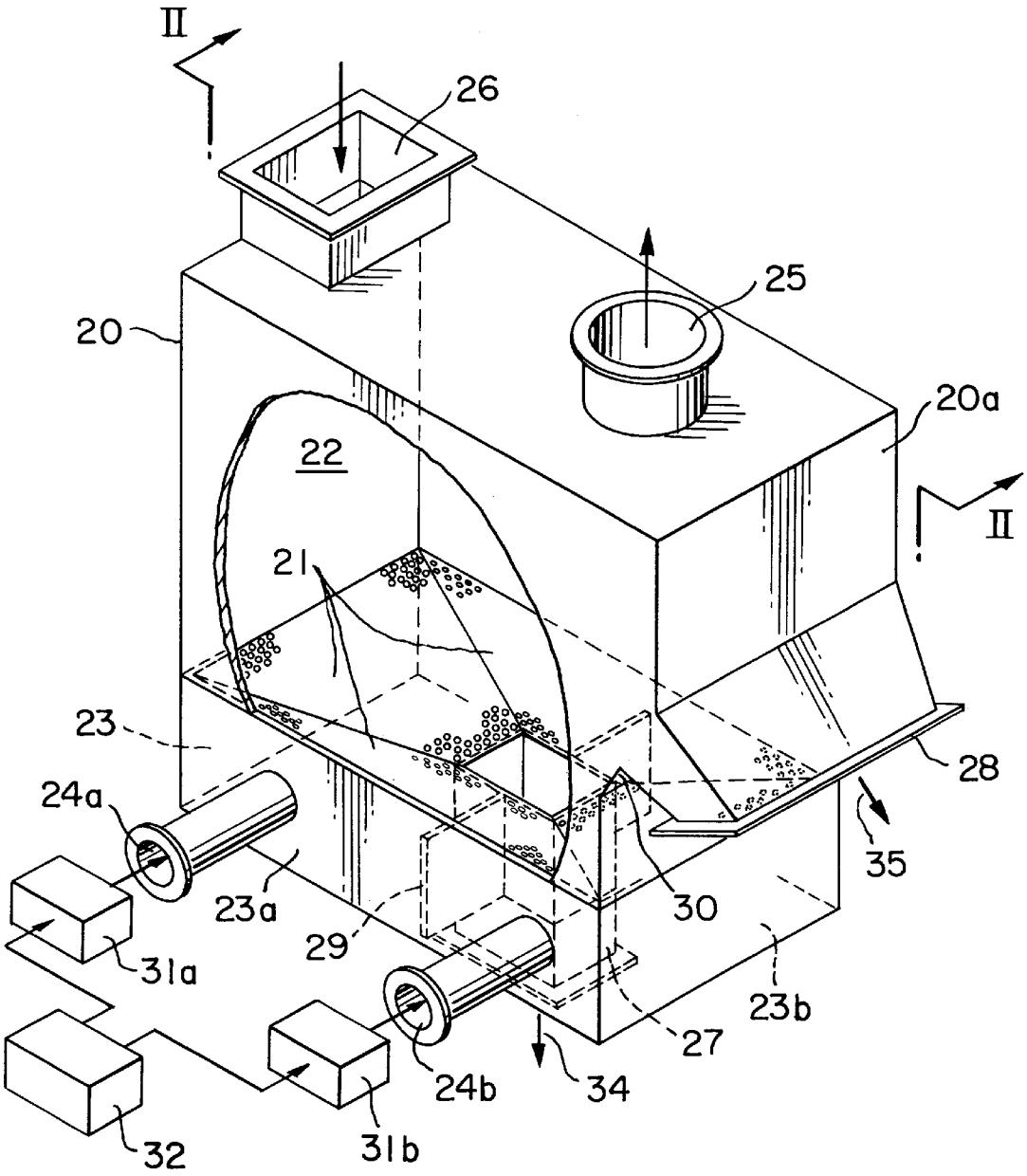
FIG. 1 is a schematic, partly cutaway, perspective view of a fluidized-bed classifier in a first embodiment according to the present invention.
Figure 2:
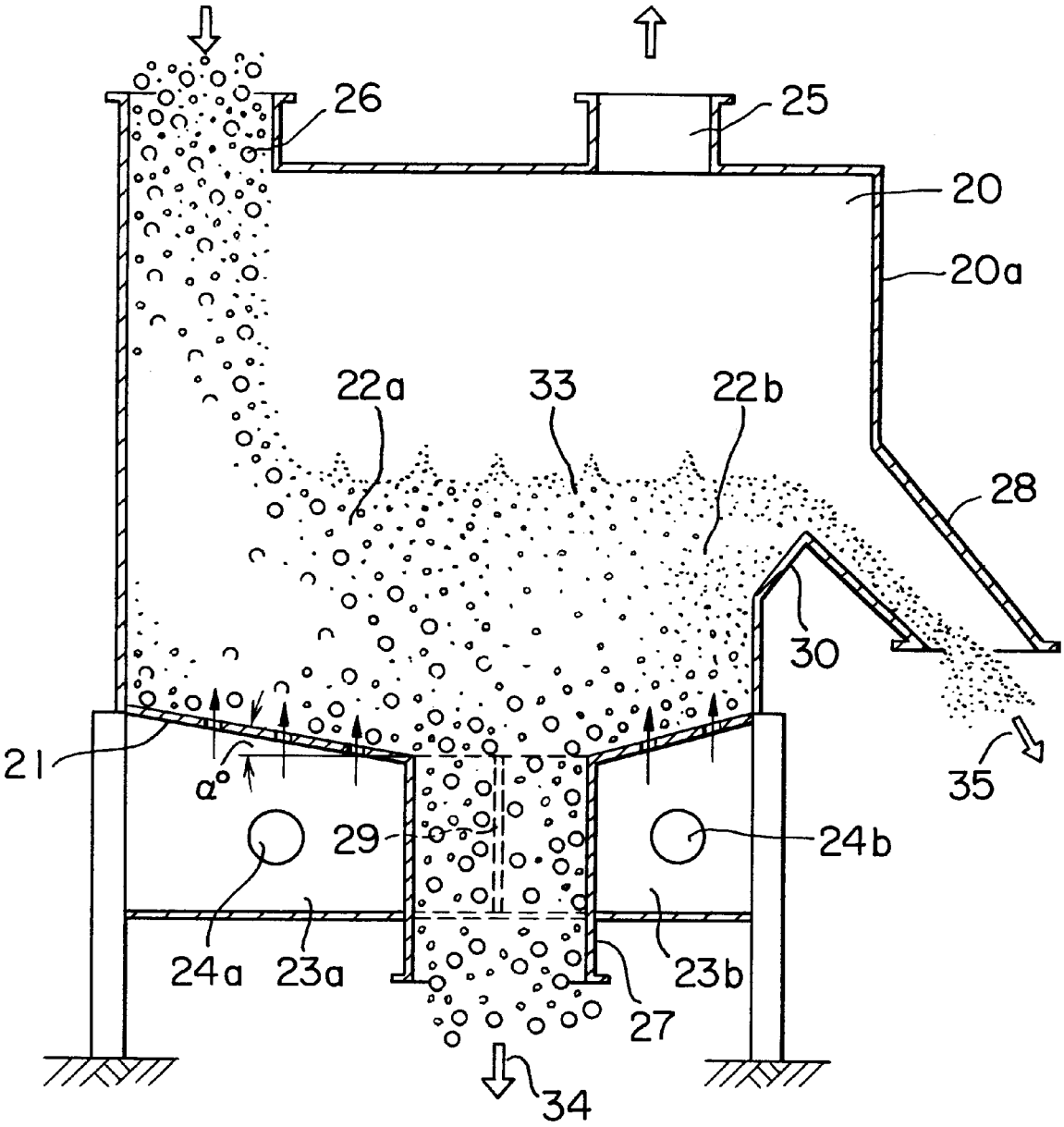
FIG. 2 is a schematic sectional view taken on line II—II in FIG. 1.

Referring to FIGS. 1 and 2 showing a fluidized-bed classifier in a first embodiment according to the present invention, a perforated dispersion plate 21 is disposed in a space defined by a generally rectangular vessel 20 to divide the space in the vessel 20 into an upper fluidized-bed chamber 22 and a lower air chamber 23. The dispersion plate 21 is sloped or funneled so that the upper surface thereof declines from the periphery toward the central portion thereof. The air chamber 23 is divided into a first air chamber 23*a* and a second air chamber 23*b* by a partition plate 29. Air is supplied into the first air chamber 23*a* and the second air chamber 23*b* through a first air supply pipe 24*a* and a second air supply pipe 24*b*, respectively. An air discharge duct 25 is joined to a portion of the upper wall of the vessel 20 corresponding to the second air chamber 23. Air supplied through the air supply pipes 24*a* and 24*b* is discharged from the vessel 20 through the air discharge duct 25. Air blown in rising currents through the dispersion plate 21 into the fluidized-bed chamber 22 produces a fluidized bed of a particulate material fed through a material feed chute 26 into the vessel 20.

A coarse particle discharge chute 27 opens into the fluidized-bed chamber 22 in a lowermost portion of the dispersion plate 21. A fine particle discharge chute 28 is joined to a portion of an end wall of the vessel 20 opposite an end wall of the same on the side of the material feed chute 26. The partition plate 29 dividing the air chamber 23 into the first air chamber 23*a* and the second air chamber 23*b* is joined to the coarse particle discharge chute 27. Air is supplied into the first air chamber 23*a* so that rising air currents of a velocity necessary for fluidizing coarse particles 34 contained in the particulate material fed into the vessel 20 are blown from the first air chamber 23*a* through the dispersion plate 21 into a first fluidized-bed region 22*a* in the fluidized-bed chamber 22. Air is supplied into the second air chamber 23*b* so that rising air currents of a velocity lower than the velocity of the rising air currents blown from the first air chamber 23*a* into the first fluidized-bed region 22*a* in the fluidized-bed chamber 22 are blown into a second fluidized-bed region 22*b* in the fluidized-bed chamber 22 so that coarse particles 34 contained in the particulate material are not fluidized and does not flow into the fine particle discharge chute 28.

The end wall 20*a* of the vessel to which the fine particle discharge chute 28 is joined has an inwardly declined portion 30 declined toward the depth of the fluidized-bed chamber 22 of the vessel 20 and merging into the lower wall of the fine particle discharge chute 28. A region above the inwardly declined portion 30 of the end wall 20*a* is not affected by the air blown through the dispersion plate 21 into the fluidized-bed chamber 22. Therefore, coarse particles 34 deposit on the inwardly declined portion 30 of the end wall 20*a* before the same flow into the fine particle discharge chute 28. The inwardly declined portion 30 of the end wall 20*a* returns the coarse particles 34 flowing near to the fine particle discharge chute 28 and deposited thereon into the fluidized-bed chamber 22 of the vessel 20 to prevent the coarse particles 34 from flowing into the fine particle discharge chute 28 together with fine particles 35.

A first air supply device 31*a* and a second air supply device 31*b* are connected to the first air supply pipe 24*a* and the second air supply pipe 24*b* connected to the first air chamber 23*a* and the second air chamber 23*b*, respectively. The respective air supply rates of the first air supply device 31*a* and the second air supply device 31*b* are controlled individually by a controller 32. Fluidizing conditions of the fluidized bed 33 in the fist fluidized-bed region 22*a* and the second fluidized-bed region 22*b* are regulated by regulating the velocities of the rising air currents blown from the first air chamber 23*a* and the second air chamber 23*b* into the first fluidized-bed region 22*a* and the second fluidized-bed region 22*b,* respectively, so that coarse particles 34 and fine particles 35 are separated efficiently.

A fluidized-bed classifier in a second embodiment according to the present invention will be described with reference to FIGS. 3 and 4, in which parts like or corresponding to those shown in FIGS. 1 and 2 are designated by the same reference characters and the description thereof will be omitted to avoid duplication.

Figure 3:
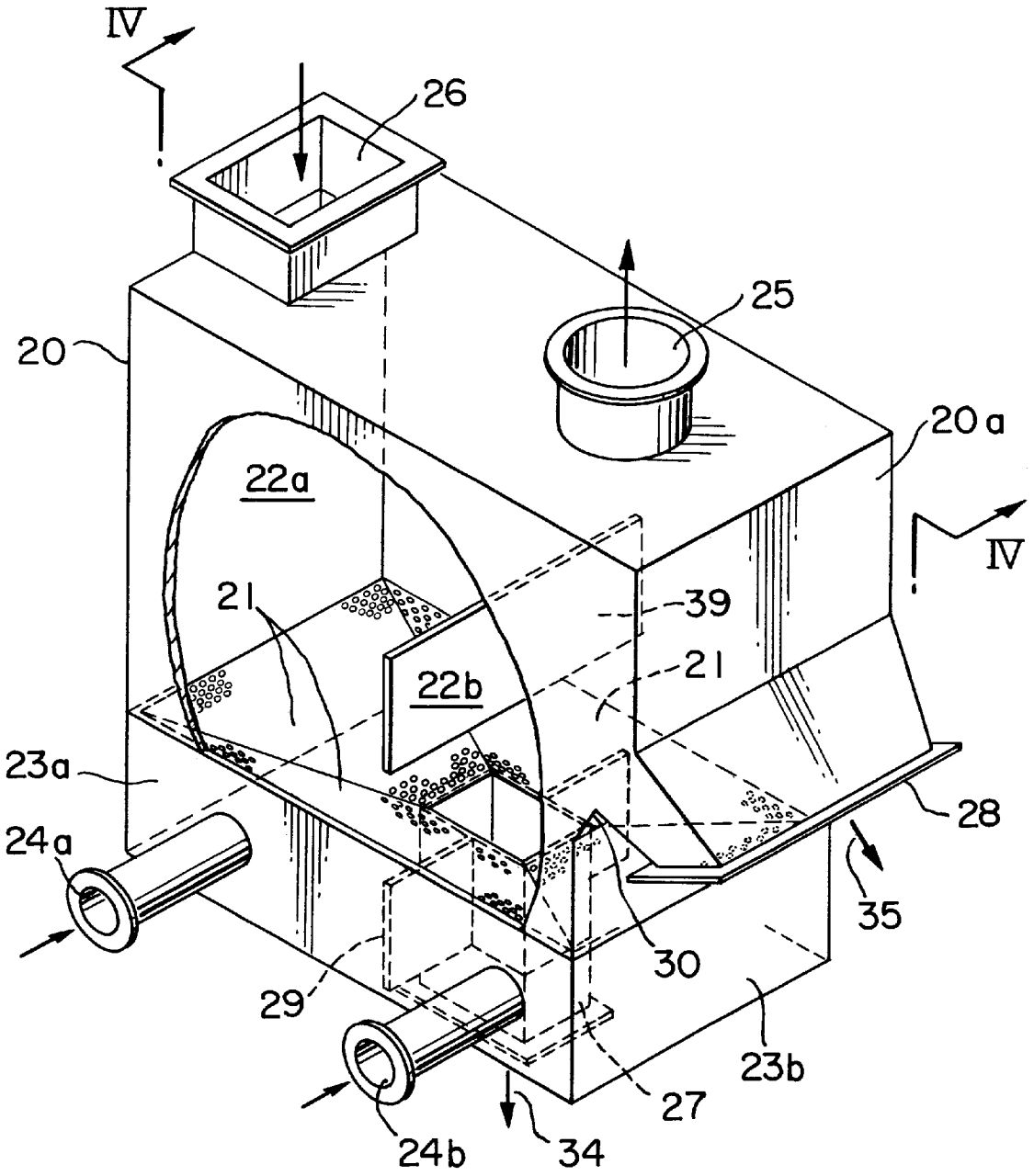
FIG. 3 is a schematic, partly cutaway, perspective view of a fluidized-bed classifier in a second embodiment according to the present invention.
Figure 4:
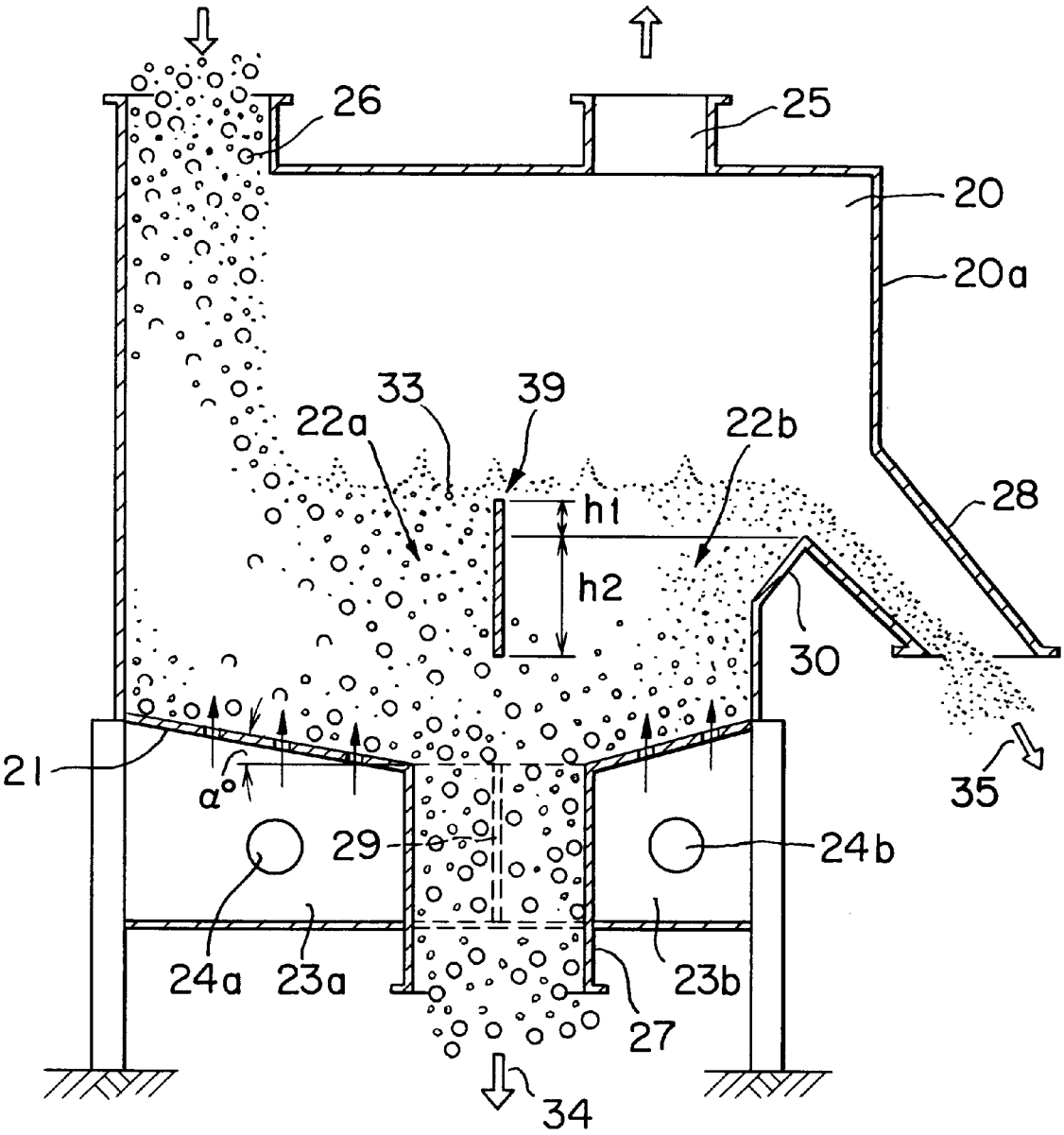
FIG. 4 is a schematic sectional view taken on line IV—IV in FIG. 3.
Figure 5:
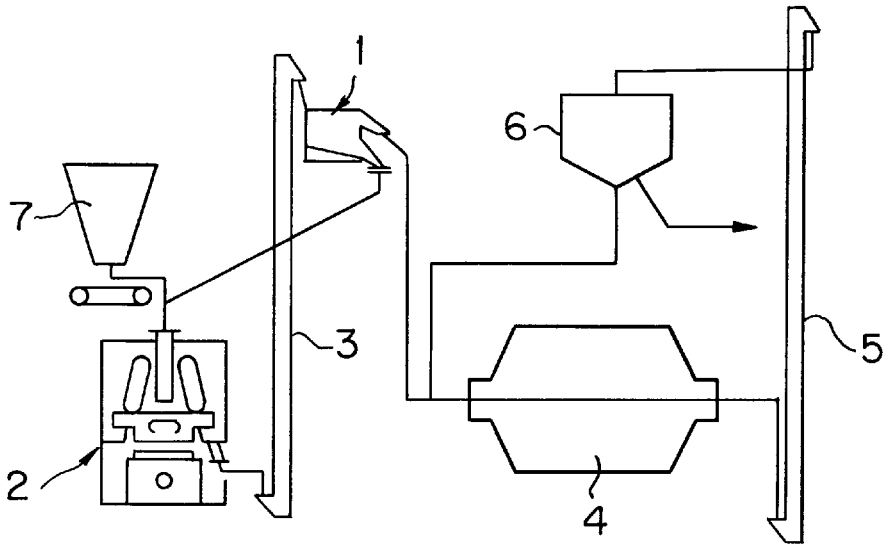
FIG. 5 PRIOR ART
FIG. 5 is a diagrammatic view of a conventional cement clinker pre-grinding system.
Figure 6:
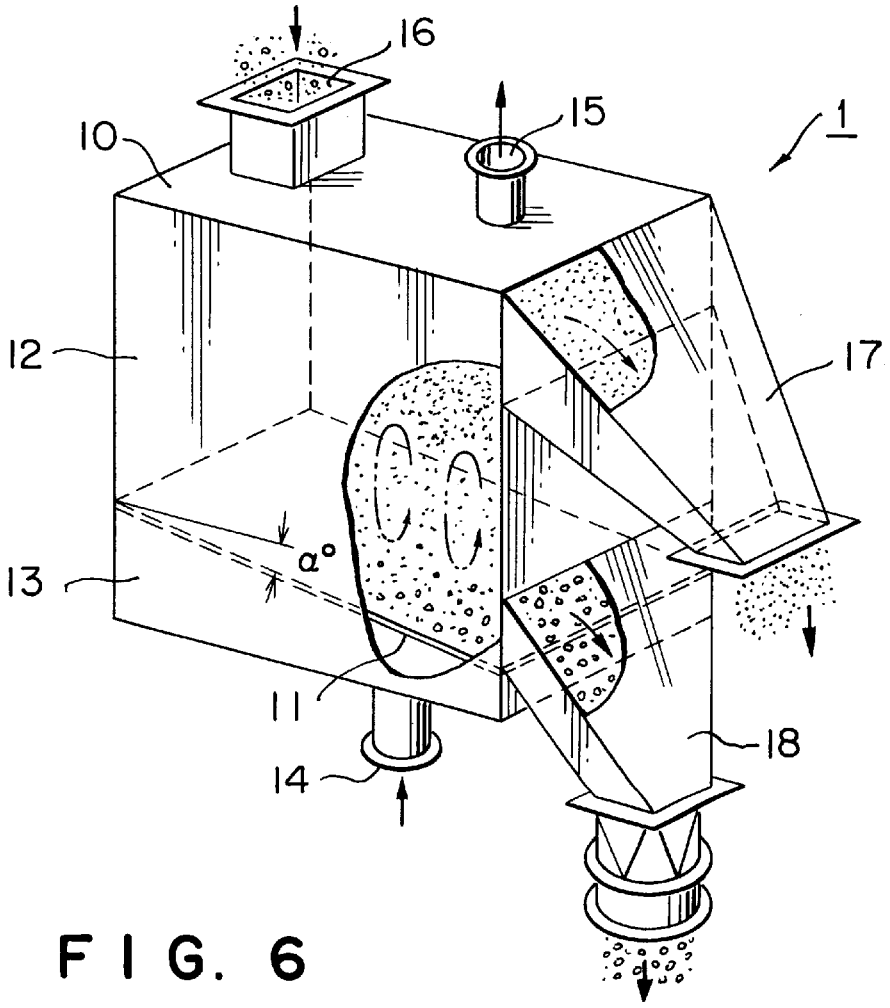
FIG. 6 PRIOR ART
FIG. 6 is a schematic, partly cutaway, perspective view of a fluidized-bed classifier included in the cement clinker pre-grinding system of FIG. 5.

Referring to FIGS. 3 and 4, a vessel 20 is provided with a fluidized bed dividing plate 39 disposed in a fluidized-bed chamber 22 to divide the fluidized-bed chamber 22 into a first fluidized-bed region 22*a* and a second fluidized-bed region 22*b,* and to isolate classifying actions in the first region 22*a* and those in the second region 22*b* from each other in order that the flow of coarse particles 34 into a fine particle discharge chute 28 can further effectively be prevented. The fluidized bed dividing plate 39 is disposed so that the upper edge thereof extends on a level at a distance h1 upward from the level of the lower side of the open end of the fine particle discharge chute 28, and the lower edge of the same is spaced a predetermined distance apart from a dispersion plate 21 and on a level at a distance h2 downward from the level of the lower side of the open end of the fine particle discharge chute 28. Coarse particles 34 of a particulate material fed through a material feed chute 26 into the vessel 20 flow under the fluidized bed dividing plate 39 toward a coarse particle discharge chute 27, while fine particles 35 flow over the upper edge of the fluidized bed dividing plate 39 toward the fine particle discharge chute 28. The distance h1 of the upper edge of the fluidized bed dividing plate 39 from the level of the lower side of the open end of the fine particle discharge chute 28 dominates the height of the fluidized bed 33 in a first fluidized-bed region 22*a.* The distance h2 of the lower edge of the fluidized bed dividing plate 39 from the level of the lower side of the open end of the fine particle discharge chute 28 is determined so that coarse particles 34 flow most efficiently toward the coarse particle discharge chute 27.

Although the foregoing embodiments use air to produce the fluidized bed 33 of the particulate material, a gas other than air, such as an inert gas or nitrogen gas, may be used instead of air when the particulate material to be subjected to classification requires.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A fluidized-bed classifier for producing a fluidized bed of a particulate material and classifying the particulate material into coarse particles and fine particles by particle size, said fluidized-bed classifier comprising:

a vessel defining a space;

a dispersion plate disposed in the vessel to divide the space defined by the vessel into an upper chamber and a lower chamber to produce a fluidized bed of the particulate material in the upper chamber by rising gas currents blown upward therethrough, and having a sloping upper surface declining from the periphery thereof contiguous with the side walls of the vessel to a lowermost portion thereof;

a coarse particle discharge chute having an inlet open end joined to a portion of the dispersion plate corresponding to the lowermost portion of the surface of the same;

a partition plate disposed in the lower chamber of the vessel at a position corresponding to the coarse particle discharge chute to divide the lower chamber into a first and a second gas chamber;

a material feed chute through which the particulate material is fed into the vessel, joined to an upper wall of the vessel at a position above a portion of the dispersion plate corresponding to the first gas chamber;

a fine particle discharge chute joined to an upper portion of an end wall of the vessel on the side of the second gas chamber; and gas supply means for supplying a gas into the first and the second gas chamber at different adjusted flow rates, respectively.

2. The fluidized-bed classifier according to claim 1, wherein said upper surface of the dispersion plate is funneled.

3. The fluidized-bed classifier according to claim 1, wherein the end wall of the vessel to which an inlet open end of the fine particle discharge chute is joined has an inwardly declining portion declined toward the interior of the upper chamber of the vessel and merging into the lower wall of the fine particle discharge chute.

4. The fluidized-bed classifier according to claim 1, further comprising a fluidized bed dividing plate disposed in the upper chamber of the vessel.

5. The fluidized-bed classifier according to claim 4, wherein an upper edge of said dividing plate is on a level above the level of the lower side of the inlet open end of the fine particle discharge chute opening into the vessel, and a lower edge of said dividing plate is spaced a predetermined distance apart from the inlet open end of the coarse particle discharge chute.

6. The fluidized-bed classifier according to claim 1, wherein said gas supply means comprising first gas supply means supplying the gas into the first gas chamber, and second gas supply means for supplying the gas into the second gas chamber, said first and second gas supplying means supplying the gas such that the rising gas currents from the first gas chamber have greater velocities than the rising gas currents from the second gas chamber.

* * * * *